US008169317B2

(12) United States Patent
Lemerand et al.

(10) Patent No.: US 8,169,317 B2
(45) Date of Patent: May 1, 2012

(54) HANDS-FREE DOOR OPENING SYSTEM AND METHOD

(75) Inventors: L. Gale Lemerand, Ormond Beach, FL (US); Robert Hubert, Port St. John, FL (US)

(73) Assignee: L. Gale Lemerand, Ormond Beach, FL (US)

( * ) Notice: Subject to any disclaimer, the term of this patent is extended or adjusted under 35 U.S.C. 154(b) by 315 days.

(21) Appl. No.: 12/710,110

(22) Filed: Feb. 22, 2010

(65) Prior Publication Data

US 2010/0253516 A1 Oct. 7, 2010

Related U.S. Application Data

(60) Provisional application No. 61/166,805, filed on Apr. 6, 2009.

(51) Int. Cl.
*G08B 13/08* (2006.01)

(52) U.S. Cl. ..... 340/545.1; 340/540; 340/686.1; 340/521; 340/815.4; 40/459

(58) Field of Classification Search ..... 340/686.6, 340/686.1, 691.6, 693.5, 660, 944, 925, 521, 340/522, 523, 528, 540, 541, 546, 545.1, 340/545.3, 555, 556, 567, 573.1, 815.4; 40/459, 40/460; 49/13, 31, 139, 140; 116/204, 307
See application file for complete search history.

(56) References Cited

U.S. PATENT DOCUMENTS

| | | | | |
|---|---|---|---|---|
| 5,583,405 | A | 12/1996 | Sai et al. | |
| 5,861,806 | A | 1/1999 | Vories et al. | |
| 5,903,217 | A | 5/1999 | Stanczak et al. | |
| 5,956,249 | A | 9/1999 | Beran et al. | |
| 6,470,512 | B1 | 10/2002 | Lau et al. | |
| 6,720,874 | B2 * | 4/2004 | Fufido et al. | 340/541 |
| 6,731,200 | B2 * | 5/2004 | Wagner et al. | 340/286.08 |
| 6,812,837 | B2 | 11/2004 | Ikeuchi | |
| 6,909,921 | B1 | 6/2005 | Bilger | |
| 6,956,495 | B2 | 10/2005 | Klein et al. | |
| 6,967,587 | B2 | 11/2005 | Snell et al. | |
| 7,061,393 | B2 * | 6/2006 | Buckingham et al. | 340/693.3 |
| 7,068,179 | B2 | 6/2006 | Snell et al. | |
| 7,274,438 | B2 | 9/2007 | Doemens et al. | |
| 7,411,489 | B1 | 8/2008 | Elwell et al. | |
| 7,765,033 | B2 * | 7/2010 | Perry | 700/275 |
| 2001/0030606 | A1 * | 10/2001 | Jaffe et al. | 340/545.6 |
| 2001/0030689 | A1 | 10/2001 | Spinelli | |
| 2005/0073425 | A1 | 4/2005 | Snell et al. | |
| 2006/0087429 | A1 | 4/2006 | Snell et al. | |

(Continued)

FOREIGN PATENT DOCUMENTS

| | | |
|---|---|---|
| CN | 101169020 | 4/2008 |

(Continued)

*Primary Examiner* — Anh V La
(74) *Attorney, Agent, or Firm* — Allen, Dyer, Doppelt, Milbrath & Gilchrist, P.A.

(57) ABSTRACT

Automatically operating a door system is controlled by an affirmative action of a patron. An occupancy status of an inside area is provided to the patron approaching the door from an outside area. The patron is directed to request the door be opened in response to an unoccupied status. A presence of the patron in the inside area is sensed and the door automatically closed, and optionally locked. One actuator is set to an in use status indicating use of the inside area by the patron. A door ready for opening status is provided to the patron. With an affirmative action with a second actuator by the patron desiring to open the door and exit the inside area, the door is unlocked and opened. Sensing an absence of the patron within the inside area, the door is automatically closed, and first actuator reset to the ready state.

17 Claims, 3 Drawing Sheets

U.S. PATENT DOCUMENTS

| | | | |
|---|---|---|---|
| 2006/0187037 | A1 | 8/2006 | Eubelen et al. |
| 2006/0244403 | A1 | 11/2006 | Christensson et al. |
| 2007/0008124 | A1 | 1/2007 | Stadler et al. |
| 2007/0182554 | A1 | 8/2007 | Elwell |

FOREIGN PATENT DOCUMENTS

| | | |
|---|---|---|
| JP | 08228965 | 9/1996 |
| JP | 08303025 | 11/1996 |
| JP | 11299706 | 11/1999 |
| JP | 2001-1330262 | 11/2001 |
| JP | 2002306377 | 10/2002 |
| JP | 2003074256 | 3/2003 |
| JP | 2005179983 | 7/2005 |
| JP | 2007191955 | 8/2007 |
| JP | 2008138440 | 6/2008 |
| WO | 2009033245 | 3/2009 |

* cited by examiner

HANDS-FREE DOOR OPENING SYSTEM AND METHOD

CROSS REFERENCE TO RELATED APPLICATION

This application incorporates by reference and claims priority to application Ser. No. 61/166,805 having filing date of Apr. 6, 2009 for "Hands-Free Door Opening System and Method," and is commonly owned.

FIELD OF THE INVENTION

The subject invention generally pertains to automatically operating a door for opening and closing the door during preselected conditions, and more specifically for a hands-free door opening system sensing an affirmative action by a patron for operating the door.

BACKGROUND OF THE INVENTION

As is well known that door handles such as those used for restrooms can undesirably carry germs due to the poor hygiene practices of others. In an effort to avoid contact with the door handle, restroom patrons will often utilize any means available to open a restroom door and exit to avoid contact with the door handle. Quite often the patrons will use their feet to pry the door open, a paper towel to insulate their hands from the door handle, grasp the door in a location other than the handle, or even wait for another patron to enter, in an effort to avoid contact with the door altogether.

Automatically operating a door for opening and closing is also well known, and typically used for permitting pedestrians to enter and exit buildings, rest rooms, hallways, and the like without having to open and close the doors manually. Such automatic doors are commonly found in retail stores, supermarkets, and the like, and are also used to facilitate and speed up passage through an entrance or exit, especially for aiding elderly or handicapped persons. Sensors are typically employed, as are video cameras.

One example of an automatic door control system is found in US application publication US 2007/0008124 for Stadler et al. disclosing a method of controlling a swinging automatic door that includes acquiring images of an area where the door swings open or closed, detecting motion in an area that fronts one side of the door when the door is closed, and causes the door to be closed to or opened when motion is detected based on image comparisons.

By way of further example, US patent application US 2006/0244403 to Christensson et al. discloses a sensor arrangement for controlling opening and closing of a door device. The sensor arrangement monitors and acquires images of a field of view that encompasses at least an approach area located adjacent said door device, and a movement detector, which is arranged to process the acquired images in order to detect a movement, which is to result in an opening of the door device.

By using a passive image sensor, the detailed and specific movement of a person can be identified and the door opened upon detection of the person. Intelligent controllers are also employed, and permit a control of the door only upon meeting preselected criteria.

While automatic door openers are well known, motion detectors typically initiate both opening and closing of doors as a patron approaches the door. The patron enters a zone in which a proximity detector detects the presence of the patron and automatically opens the door. There are certain drawbacks of these automatic door openers especially in the close quarters of a public restroom. For example, due to the small size of many public restrooms, proximity detectors can activate from almost any movement in the restroom. This results in the constant opening and closing of the restroom door due to the movement of the patron inside the restroom. In addition, patrons entering the restroom from the outside will often trigger the door to swing inward where another patron may be standing.

Attempts to remedy these drawbacks have been made by way of motors or opening mechanisms that stop progress when obstructed. While these improvements resolve a portion of the problems in that the patron in the path of the door is not injured, it is still inconvenient for all involved. It is desirable to have a door that can be opened both manually or automatically upon the affirmative action of a patron. This allows for a choice of automatically or manually opening the door, as well as making the patron aware of the doors automatic opening so that any impedance may be avoided. It is further desirable to be able to manually and automatically lock and unlock the door.

SUMMARY

Embodiments of the invention are directed to a system and method for providing an automatic door opener initiated upon an affirmative action by a user or patron. One embodiment for automatically operating a door may comprise an actuator, a locking mechanism, a control unit, and a power assisted drive mechanism. The drive mechanism may include a limiter in communication with a conventional door closer allowing the door to be opened manually from the inside or outside or automatically upon an affirmative action by the patron, as disclosed in U.S. Pat. Nos. 6,967,587 and 7,068,179, the disclosures of which are herein incorporated by reference in their entirety. One affirmative action, herein described by way of example, comprises a hand waving wherein the patron is provided instruction through iconic symbols triggered by the proximity of the patron to the actuator. One embodiment of the invention may comprise one such affirmative action for locking and unlocking the door.

Actuators may be mounted in any area near a restroom door both inside and outside the room, and may comprise a proximity sensor for detecting the proximity of a patron within at least one specific proximity zone. Multiple zones may be established and correspond to specific distances from the activator.

One embodiment of the invention includes a locking system that automatically unlocks and opens the door when the touch-free actuator is activated. Features may include an emergency unlock override from the outside of the room (via a key or some other manual system), a touch-free entrance actuator with iconic instructions that would "De-activate" after a patron activates the operator from outside the room and enters with the door closing behind the patron. Additionally, a touch-free exit actuator with iconic instructions automatically unlocks and opens the door for a touch-free exit, or a combination of the above as may be desired to satisfy a specific need. Further, a sensor may be positioned for detecting a patron passing through a portal for the room or positioned within the room.

A method aspect of the invention comprises automatically operating a door system by a patron desiring to enter an inside area from an outside area through a portal secured by a door. The method may comprise setting the door system including the controller to a ready state, providing an occupancy status of the inside area to the patron approaching the first actuator in the outside area, directing the patron to request the door be opened in response to an unoccupied status for the inside area, providing an actuating signal by the patron to the first actuator by the patron desiring to open the door, transmitting a door opening signal from the first actuator to the controller, opening the door in response to the door opening signal from the controller to the motorized mechanism, sensing a presence of the patron within the inside area using a presence sensor, automatically closing the door in response to a door closing signal from the controller, optionally locking the door in response to a latching signal from the controller, setting the first actuator to an in use status, indicating the in use status for the inside area at the first actuator, and indicating a door ready for opening status at the second actuator.

Yet further, the method may comprise providing an actuating signal to the second actuator by the patron desiring to open the door and exit the inside area, unlocking the door in response to an unlatching signal from the controller, transmitting a door opening signal from the second actuator to the controller, opening the door in response to the door opening signal from the controller to the motorized mechanism, sensing an absence of the patron within the inside area using the presence sensor, automatically closing the door in response to a door closing signal from the controller, and setting the first actuator to the ready state.

Optionally, the method may comprise the first actuator providing a fixed first lighted legend to the patron in a first color during the ready state. Further, the method may comprise the first actuator providing an intermittently second lighted legend to the patron in the first color during the ready state.

During the use state, the method may comprise the first actuator providing a second fixed lighted legend to the patron in a second color, and alternatively, the first actuator providing a fixed second lighted legend to the patron in the second color.

For one method aspect of the invention during the in use state, the second actuator provides the second fixed lighted legend to the patron in the second color. Optionally, the second actuator provides the intermittently second lighted legend to the patron in the first color. The intermittently first and second lighted legends may comprise an iconic image.

Method aspects may comprise sensing the patron entering a proximity zone of the first actuator positioned within the outside area, locking the door in the ready state and unlocking the door prior to the door opening step, the automatically door closing in response to the door closing signal from the controller is based on at least one of a signal from the presence sensor that the patron is occupying the inside area, and a timing signal from a timer, the actuating signal providing by the patron to the first and second actuators comprises the patron waving a hand proximate the actuator.

The door opening may comprise initiating the door opening, partially opening the door, wherein the door contacts an obstacle and retards the opening, and automatically stopping the door opening for allowing the obstacle to be removed. Optionally, the door opening may comprises at least one of the door mechanism swinging the door from an closed to open position and sliding the door from a closed to an open position.

A method aspect may further comprise sensing the absence of the patron after sensing the presence of the patron within the inside area, and automatically transmitting the unlatching signal to the controller. The door may be set to the ready state for while in the in use status the presence sensor no longer senses the presence of the patron after a predetermined period of time.

BRIEF DESCRIPTION OF THE DRAWINGS

For a fuller understanding of the invention, reference is made to the following detailed description, taken in connection with the accompanying drawings, in which.

DETAILED DISCLOSURE OF THE INVENTION

The present invention will now be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be complete, and will fully convey and disclose the invention to those skilled on the art.

Figure 1:
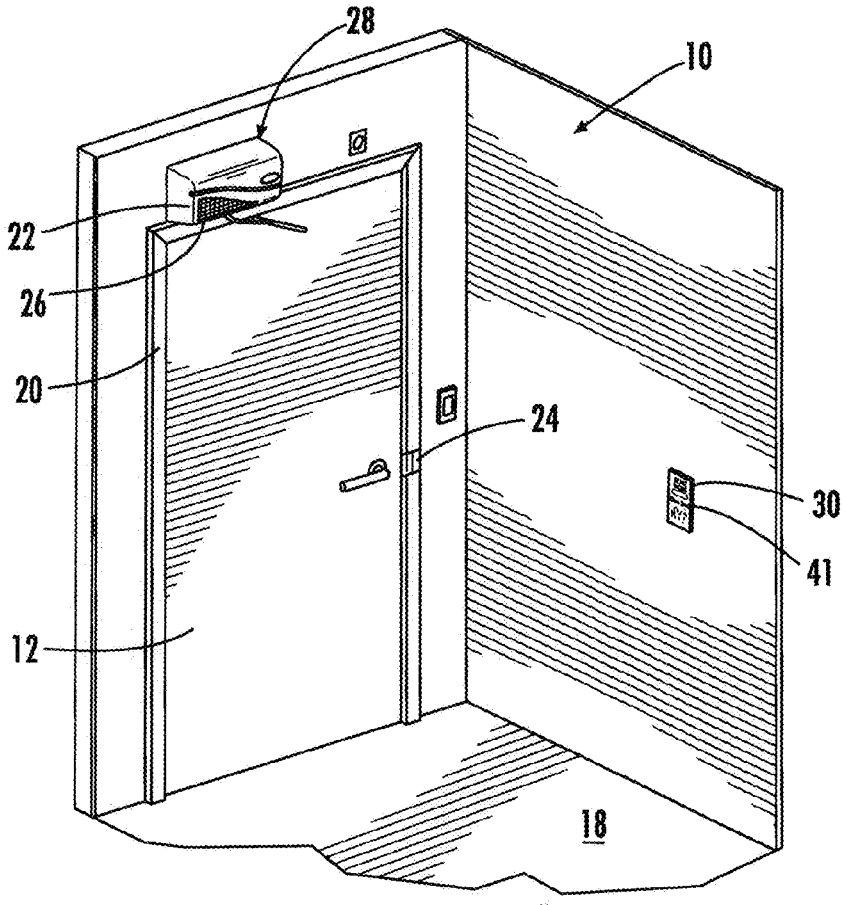
FIG. 1 is a partial diagrammatical perspective view of a door operable for swinging open and closed responsive to an actuator communicating with a motorized door opener.
Figure 2:
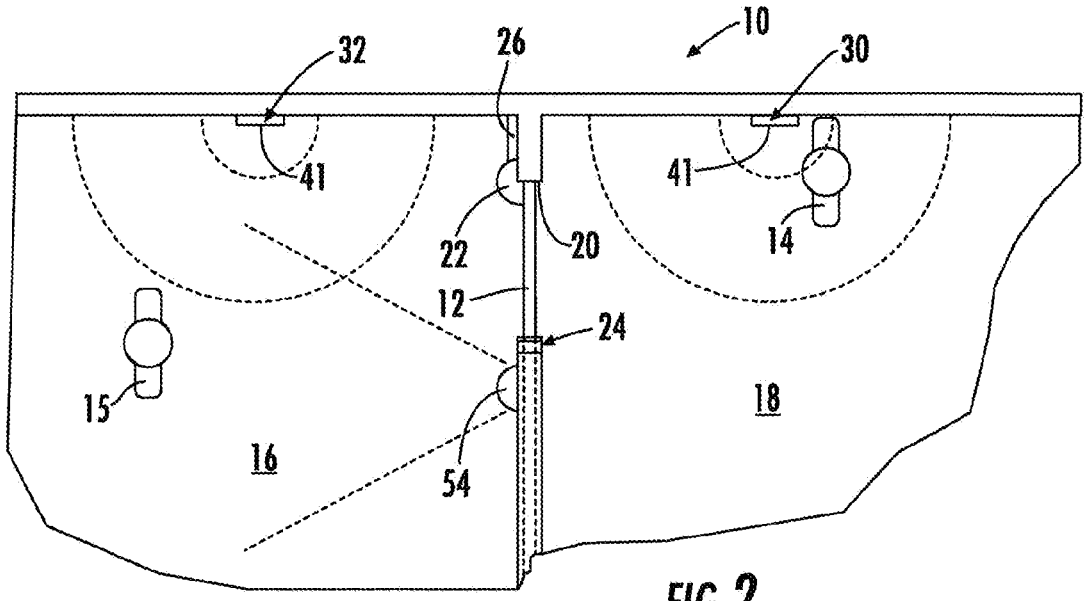
FIG. 2 is a partial diagrammatical plan view illustrating an embodiment of a door system in keeping with the teachings of the present invention.

Referring now to FIGS. 1 and 2, one embodiment of a door opening system 10 in keeping with the teachings of the present invention is directed to operating a door 12 by a patron 14 desiring to enter an inside area 16 (such as a restroom) from an outside area 18 (such as a lobby) through a portal 20 secured by the door. While a swinging door is illustrated with reference to FIG. 1, it will be understood by those of ordinary skill in the art that sliding doors, such as illustrated with referee to FIG. 2, are appropriate for embodiments of the invention. Operation of the door 12 is controlled by a motorized mechanism 22 and locked by a latching mechanism 24 communicating with a controller 26 carried within a housing 28 for the embodiment described with reference to FIG. 1, but alternatively may be a separate unit as illustrated with reference to FIG. 2.

With continued reference to FIGS. 1 and 2, the controller 26 sends and receives electrical signals to a first actuator 30 positioned within the outside area 18 and a second actuator 32 positioned within the inside area 16. The controller is responsive to signals received by the first and second actuators for operating the door 12 using the motorized mechanism 22 having a door opener and closer actuated by connection to a main printed circuit board of the controller. The system 10 herein described, by way of example, includes the latching mechanism 24 also communicating with the controller 26 for automatically locking and unlocking of the door 12 in response to actions taken by the patron.

Figure 3:
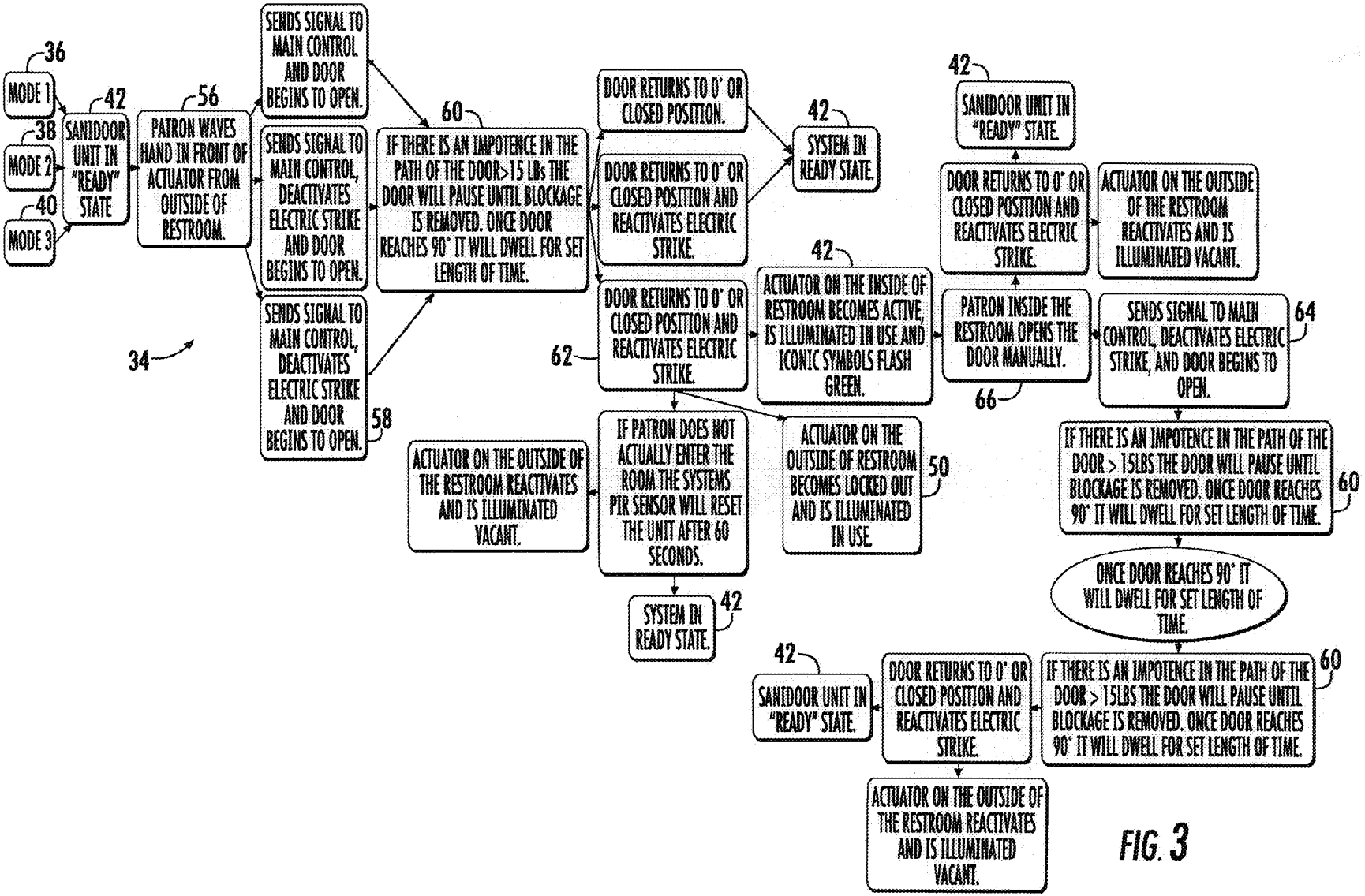
FIG. 3 is a flow chart illustrating functional operation of embodiments of the present invention for three illustrative modes of operation.

For embodiments of the invention, herein described by way of example, the operation of the door 12 may include multiple preset modes 34 as illustrated with reference to FIG. 3, and further detailed later in this specification. For embodiments of the invention as herein described, the first and second actuators 30, 32 include faceplates 36, as illustrated with reference to FIGS. 4A-6B and include an iconic display 38 and instructions 40 for the patron to actuate a touch-free method of opening the door 12. By way of example, when the patron waves a hand near the actuator 30, a signal is sent to the controller 26 carrying to automatically actuate the motorized mechanism 22 and open the door 12. As will be further detailed later in this description, actions may include closing the door 12, activating and/or deactivating the second actuator 32 located within the inside area 16, locking the door, unlocking the door, or a combination thereof as desired.

Figure 4A:
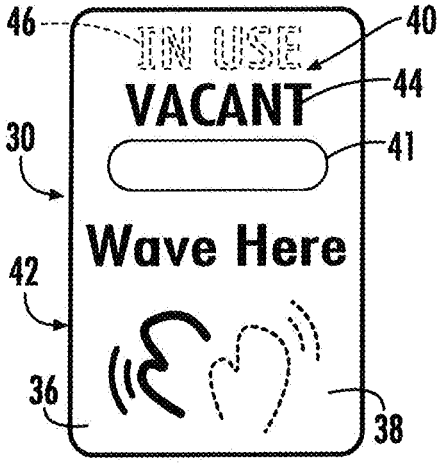
FIGS. 4A and 4B are diagrammatical illustrations of one actuator and its faceplate in ready and locked states, respectively, for use in an outside a room, the faceplate including an iconic display and multicolor illumination.
Figure 4B:
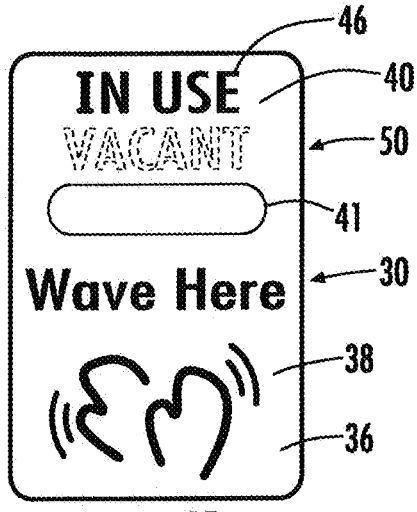

By way of further example and with reference again to FIG. 2, as the patron 14 approaches the door 12, a proximity detector 41 carried by the actuator 30 detects the presence of the patron (see also FIG. 4A). Detecting the presence of the patron, the first actuator 30 flashes a first signal which alerts the patron to the presence of the actuator and provides the "wave hand" iconic display 38 instructing the patron to wave his or her hand in front of the first actuator 30. Alternatively, the actuator 30 may continuously flash the display 38. The actuator 30 sends a signal to the controller 26 which signals the motorized mechanism 22.

By way of further example, and with reference again to FIG. 3, the three modes of operation 34 may be employed as herein described, but are not intended to be limited to such modes. A first mode of operation of the system 10 may be described for opening and closing the door 12 as described in U.S. Pat. Nos. 6,967,587 and 7,068,179, the disclosures of which are herein incorporated by reference in their entirety.

A second mode of operation 38 includes opening and closing the door 12 wherein the system 10 comprises the latching mechanism 24. This second mode 38 will generally follow that of the first mode 36, but may be used with both the first and second actuators 30, 32 and incorporate the latching mechanism 24 for the door 12 that requires a positive latching thereof. By way of example, the patron 12 sends a signal to the controller 26 through his positive action of waving his hand in front of the actuator 30. This sends a signal to an electric strike operable with the latching mechanism 24 and the door 12 to disengage the strike and begin an opening cycle for the opening door.

As above described with reference to FIGS. 1 and 2, the outside area 18 may be equipped with the first actuator 30, and the inside area 16 equipped with the second actuator 32. With reference again to FIG. 4A, while the actuators 30, 32 are generally similar, they will be operated based on need. By way of example, when the system 10 is in a ready state 42, the first actuator 30 will display a "vacant" message 44 indicating to the patron 14 that the inside area 16 is available for use. An "in use" message 46 will not be displayed and hidden from view. The iconic display 38 will intermittently flash in one color, such as a green color 48, for viewing by the patron 14. The vacant message 44 may be displayed in the green color as well. As illustrated now with reference to FIG. 4B, when the system 10 is placed in a locked door state 50, the in use message 46 will now be displayed and the green vacant message 44 hidden from view. In the locked door state 50, the iconic display 38 will be shown as a steady state, solid red color 52.

Figure 5A:
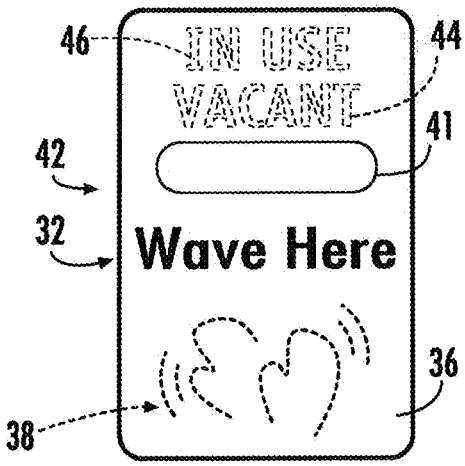
FIGS. 5A and 5B are diagrammatical illustrations for an actuator and its faceplate in ready and locked states, respectively, for use in an inside area, the faceplate including an iconic display and multicolor illumination.

As illustrated with reference to FIG. 5A, the second actuator 32 located in the inside area 16, the vacant message 44, the in use message 46, and the iconic display 38 will be hidden from view when the system 10 is in the ready state 42. As illustrated with reference to FIG. 5B, in the locked door state 50, the second actuator 32 will display the in use message 46 in the red color 52 and the iconic display 38 as a flashing green color 48. Yet further, and with reference to FIGS. 6A and 6B, other options will come to the mind of those skilled in the art regarding use of the actuators and information carried by the face plate now having the benefit of the teachings of the present invention.

By way of further example, and with reference again to FIGS. 2 and 3, consider the inside area 16 to be a single use restroom wherein the two touch-free actuators 30, 32 are used in conjunction with the electronic strike plate of the latching mechanism 24, and a presence sensor 54 monitoring the inside area 16 (herein a passive infrared (PIR) sensor used by way of example). When the patron 14 approaches the restroom door 14, the first actuator 30 will be illuminated with the green flashing iconic display 38 (flashing LED lights may be used) indicating that the restroom 16 is vacant or available. The patron 14 then waves his hand in front of the actuator 30 thus sending a signal to the controller 26 to disengage the electric strike of the latching mechanism 24 and open the door 12. Upon entering the restroom 16, the door 12 is closed and the first actuator 30 illuminates to indicate an occupied restroom, as earlier described with reference to FIG. 4B. The first actuator 30 at the outside area 18 would now be "inoperable" by any patron as earlier described with reference to FIG. 4B and the door 12 locked. By way of example, if another patron tries to activate the first actuator while in the "in use" state, an audible tone may optionally be heard to acknowledge the activation attempt, but the door will not open.

The presence sensor 54 monitors the inside area 16 to ensure a person, in this case the patron, now identified as patron 15 is inside the room. If for some reason the patron 14 did not enter the restroom 16, the system 10 will be reset after a specified time and the first actuator 30 will become active again. With the patron 15 inside the restroom 16, and as earlier described with reference to FIG. 5B, the second actuator 32 will have red illuminating the in use message 46, an occupied window, and green flashing indicia 38 to indicate the door 12 is ready to be opened from the inside area. Once the patron 15 activates the second actuator 32, a signal is sent to the controller 26 to disengage the electric strike of the latching mechanism 24 and the restroom door 12 is opened. When the door 12 closes, the system 10 is reset and ready to be opened from the outside again.

The door 12 may be manually opened from the outside by manually unlocking the door handle via a key to bypass the electric strike. If the patron 15 were to manually open the door 12 from the inside area 16 and exit the restroom, the sensor 54 recognizes that the inside area 16 is empty and the system 10 will be reset to the ready state 42.

Figure 5B:
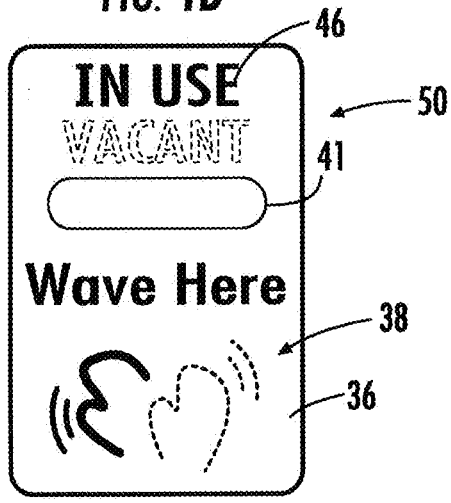
Figure 6A:
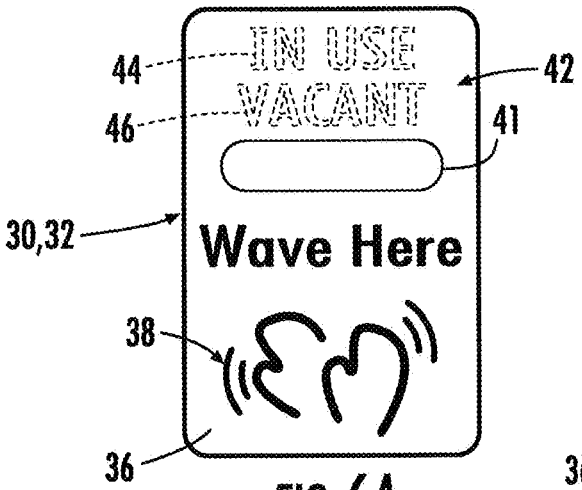
FIGS. 6A and 6B are diagrammatical views of one actuator and its faceplate in ready and locked states, respectively, for general use.
Figure 6B:
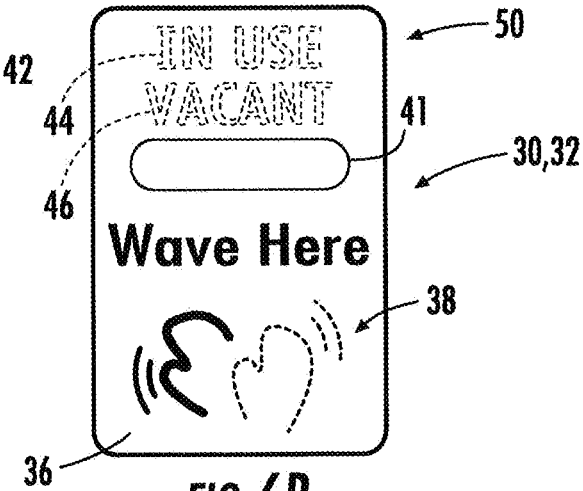

One embodiment of the invention is now herein described, by way of example, with reference again to FIG. 2. One process employing the system 10 is herein described as the third mode of operation 40. The process for automatically operating a door 10 by the patron 12 desiring to enter the inside area 16 from the outside area 18 uses the motorized mechanism 22 to open and close the door, and locks the door using the latching mechanism 24, both communicating with the controller 26, wherein the controller communicates with the first actuator 30 positioned within the outside area 18 and the second actuator 32 positioned within the inside area 16. The controller 26 is responsive to signals received by the first and second actuators 30, 32 initiated by affirmative actions by the patron. One embodiment of the process includes:

(a) setting the system 10 to the ready state 42;

(b) providing an occupancy status of the inside area 16 to the patron 14 approaching the first actuator 30 in the outside area 18;

(c) directing the patron 14 to request that the door 12 be opened in response to an unoccupied status for the inside area 16;

(d) providing an actuating signal by the patron 14 to the first actuator 30 when the patron 14 (typically waving his hand 56 as illustrated with continued reference to FIG. 2) would like to open the door 12;

(e) transmitting a door opening signal 58 from the first actuator 30 to the controller 26;

(f) opening the door 12 using the motorized mechanism 22 in response to the door opening signal from the controller 26 (if there is impotence toward opening the door, the opening will pause until the impotence is removed);

(g) sensing a presence of the patron 15 within the inside area 16 using the presence sensor 54 (as will come to the mind of those skilled in the art, while the movement of the patron 14 is herein monitored, the patron 15 may indeed be another patron already using the inside area 16);

(h) automatically closing the door 12 in response to a door closing signal from the controller 26;

(i) locking the door 12 in response to a latching signal from the controller 26;

(j) setting the first actuator 30 to an in use status, the locked door state 50, above described;

(k) indicating the in use status for the inside area 16 at the first actuator 30; and (l) indicating a door ready for opening status at the second actuator 32, as above described with reference to FIG. 5B.

With continued reference to FIG. 2, the process may further include:

(m) providing an actuating signal to the second actuator 32 by the patron 15 desiring to open the door 12 and exit the inside area 16;

(n) unlocking the door 12 in response to an unlatching signal from the controller 26 after the patron 15 indicated the wish to leave 64 the inside area (o) transmitting a door opening signal from the second actuator 32 to the controller 26 (as above described, the patron 15 may manually open 66 the door (p) opening the door 12 using the motorized mechanism 22 in response to the door opening signal from the controller 26;

(q) sensing an absence of the patron 15 within the inside area 16 using the presence sensor 54;

(r) automatically closing the door 12 in response to a door closing signal from the controller 26; and (s) setting the first actuator 30 to the ready state 42.

In keeping with the teachings of the present invention, a conventional door closer may include a preexisting door closer or a door closing apparatus integrated into the system. Conventional door closers generally comprise an external gear on the top and bottom of the closer that rotates with the opening and closing of the door to which it is attached. When the external gear of the door closer is rotated in the appropriate direction, the door closer can be reversed and can operate to open the door. The motorized mechanism 22 may include a motor, a gearbox and a limit unit. The motor may be an AC or a DC motor, unidirectional or bi-directional. The gearbox may comprise a variety of gears to translate the torque of the motor to the limiting unit that is attached to an external gear on the door closer. For example, the gearbox may comprise a series of reduction gears in further communication with the limit unit. The limit unit provides for the positive opening of the door by the power-assisted drive mechanism. While there is a variety of methods in which to accomplish this task, the method disclosed herein allows for power-assisted door opening as well as unobstructed manual door opening.

Many modifications and other embodiments of the invention will come to the mind of one skilled in the art having the benefit of the teachings presented in the foregoing descriptions and the associated drawings and photos. Therefore, it is to be understood that the invention is not to be limited to the specific embodiments disclosed, and that modifications and alternate embodiments are intended to be included within the scope of the claims supported by this specification.

That which is claimed is:

1. A method for automatically operating a door system by a patron desiring to enter an inside area from an outside area through a portal secured by a door, wherein operation of the door is controlled by a motorized mechanism and locked by a latching mechanism communicating with a controller, the controller communicating with a first actuator positioned within the outside area and a second actuator positioned within the inside area, the controller responsive to signals received by the first and second actuators for operating the door, the method comprising:

setting the door system including the controller to a ready state;

providing an occupancy status of the inside area to the patron approaching the first actuator in the outside area;

directing the patron to request the door be opened in response to an unoccupied status for the inside area;

providing an actuating signal by the patron to the first actuator by the patron desiring to open the door;

transmitting a door opening signal from the first actuator to the controller;

opening the door in response to the door opening signal from the controller to the motorized mechanism;

sensing a presence of the patron within the inside area using a presence sensor;

automatically closing the door in response to a door closing signal from the controller;

locking the door in response to a latching signal from the controller;

setting the first actuator to an in use status;

indicating the in use status for the inside area at the first actuator; and indicating a door ready for opening status at the second actuator.

2. The method according to claim 1, further comprising:

providing an actuating signal to the second actuator by the patron desiring to open the door and exit the inside area;

unlocking the door in response to an unlatching signal from the controller;

transmitting a door opening signal from the second actuator to the controller;

opening the door in response to the door opening signal from the controller to the motorized mechanism;

sensing an absence of the patron within the inside area using the presence sensor;

automatically closing the door in response to a door closing signal from the controller; and setting the first actuator to the ready state.

3. The method according to claim 1, wherein, during the ready state, the first actuator provides a fixed first lighted legend to the patron in a first color.

4. The method according to claim 1, wherein, during the ready state, the first actuator provides an intermittently second lighted legend to the patron in the first color.

5. The method according to claim 1, wherein, during the in use state, the first actuator provides a second fixed lighted legend to the patron in a second color.

6. The method according to claim 1, wherein, during the in use state, the first actuator provides a fixed second lighted legend to the patron in the second color.

7. The method according to claim 1, wherein, during the in use state, the second actuator provides the second fixed lighted legend to the patron in the second color.

8. The method according to claim 1, wherein, during the in use state, the second actuator provides the intermittently second lighted legend to the patron in the first color.

9. The method according to claim 1, wherein the intermittently first and second lighted legends comprise an iconic image.

10. The method according to claim 1, further comprising sensing the patron entering a proximity zone of the first actuator positioned within the outside area.

11. The method according to claim 1, further comprising locking the door in the ready state and unlocking the door prior to the door opening step.

12. The method according to claim 1, wherein the automatically door closing in response to the door closing signal from the controller is based on at least one of a signal from the presence sensor that the patron is occupying the inside area, and a timing signal from a timer.

13. The method according to claim 1, wherein providing the actuating signal by the patron to the first and second actuators comprises the patron waving a hand proximate the actuator.

14. The method according to claim 1, wherein the door opening comprises:

initiating the door opening;

partially opening the door, wherein the door contacts an obstacle and retards the opening; and automatically stopping the door opening for allowing the obstacle to be removed.

15. The method according to claim 1, wherein the door opening comprises at least one of the door mechanism swinging the door from an closed to open position and sliding the door from a closed to an open position.

16. The method according to claim 1, further comprising:

sensing the absence of the patron after sensing the presence of the patron within the inside area; and automatically transmitting the unlatching signal to the controller.

17. The method according to claim 1, further comprising setting the door to the ready state for while in the in use status the presence sensor no longer senses the presence of the patron after a predetermined period of time.

* * * * *